US006287037B1

(12) United States Patent
Hay

(10) Patent No.: US 6,287,037 B1
(45) Date of Patent: Sep. 11, 2001

(54) HAND-HELD CLEANING DEVICE

(75) Inventor: Donald Hay, Wanchai (HK)

(73) Assignee: Hayco Manufacturing Ltd. (HK)

( * ) Notice: Subject to any disclaimer, the term of this patent is extended or adjusted under 35 U.S.C. 154(b) by 0 days.

(21) Appl. No.: 09/483,319

(22) Filed: Jan. 14, 2000

(51) Int. Cl.[7] ..... A46B 11/04

(52) U.S. Cl. ..... 401/273; 401/270; 401/279; 401/278

(58) Field of Search ..... 401/273, 272, 401/270, 278, 279, 183, 184, 186, 205, 206

(56) References Cited

U.S. PATENT DOCUMENTS 825,448 * 7/1906 Farron ..... 401/186
1,087,919 * 2/1914 Buckley ..... 401/186
1,425,242 * 8/1922 Dinardo ..... 401/278
1,505,442 * 8/1924 Stephens ..... 401/278
1,865,850 * 7/1932 Garvey ..... 401/186
4,298,778 * 11/1981 Beresford-Jones ..... 200/302.2
4,955,746 * 9/1990 Craigmile ..... 401/278

FOREIGN PATENT DOCUMENTS

323242 * 7/1920 (DE) ..... 401/278

* cited by examiner

*Primary Examiner*—David J. Walczak
(74) *Attorney, Agent, or Firm*—Reese Taylor

(57) ABSTRACT

A fluid-containing brush has a housing (11) with a generally cylindrical wall closed at one end by a base carrying brush bristles (25) and at the other by a cap (50) formed of resilient material, the housing defining a fluid reservoir, the base having a central opening therein closed by a valve member for dispensing liquid to the brush bristles, and a valve stem (31) which extends up to an underside of the cap (50) the housing and cap being adapted to provide a fluid tight seal therebetween, and the cap having a deformable portion constituting a button (58) by which the user can actuate the valve to dispense cleaning fluid.

11 Claims, 4 Drawing Sheets

HAND-HELD CLEANING DEVICE

BACKGROUND OF THE INVENTION

The present invention relates to hand-held cleaning devices and, in particular, to such devices which carry and dispense cleaning fluid.

Prior soap-dispensing cleaning devices are known which include a housing defining a soap-containing reservoir, a bottom wall of the housing carrying a cleaning medium, such as a sponge, brush or the like, the reservoir being closed by a cap. A valve assembly dispenses fluid from the reservoir to the cleaning medium. One such device is disclosed in EP-A-0198 389. Here, there is provided at the base of the housing a valve assembly having a lower opening defining a value seat, and a thin valve stem protruding downwardly through the opening. As the user presses the bottom of the device against an object to be cleaned the valve stem is forced upwardly against the action of a resilient support, allowing the soap to drain from the reservoir.

One problem with this structure is that the device is prone to leakage both at the position of the valve and at the screw cap.

The invention seeks to provide an improved fluid-containing cleaning device which avoids the disadvantages of prior such devices while affording additional structural and operating advantages.

SUMMARY OF THE INVENTION

According to tho present invention there is provided a hand-held cleaning device comprising a housing constituting a reservoir for cleaning fluid and carrying cleaning means for contacting an object or surface to be cleaned, a lower aperture through which cleaning fluid may pass closed by valve means which are operable by a user, an upper opening through which cleaning fluid may be introduced, and a removable cap closing the upper opening formed of resilient material and adapted to provide a fluid-tight seal with the housing, the cap having a portion which is deformable by a user, a part of the valve means extending to said portion whereby a user can operate the valve means on deformation of the said portion.

This arrangement allows both the sealing function and the external user actuation of the valve to be readily achieved, resulting in a device of particularly simple yet effective construction.

In a preferred embodiment the housing has a sidewall which is provided in the region of its upper end with an outwardly extending circumferential lip, whilst the cap has on its underside a circumferential groove into which the lip fits. The diameter of the lip is preferably slightly larger than the diameter of the groove whereby when fitted the cap is in tension so that a tight seal is formed therebetween.

The housing may further define at its uppermost end a neck of reduced diameter defining the upper opening which is formed with a circumferential bead, whilst the cap defines an annular surface which engages the neck with the bead thereof tightly fitting against this annular surface.

Preferably, the valve means comprises a valve stem which extends through the housing to the cap having an end portion which lies adjacent an inner surface of the deformable portion of the cap. The valve means includes a valve member arranged on an end of the valve stem which sits in a valve seat, the valve stem being biased by resilient means towards cap so that the valve member engages in the valve seat.

The inner surface of the cap may further comprise a cylindrical skirt portion depending from the cap in which an end portion of the valve stem is received. The cap may also have a groove in its outer surface defining the deformable button portion.

The cap is preferably formed of a natural or synthetic rubber or an elastomeric material.

BRIEF DESCRIPTION OF THE DRAWINGS

Embodiments of the present invention are now described, by way of example only, with reference to the following drawings in which.

BRIEF DESCRIPTION OF THE PREFERRED EMBODIMENT

Figure 1:
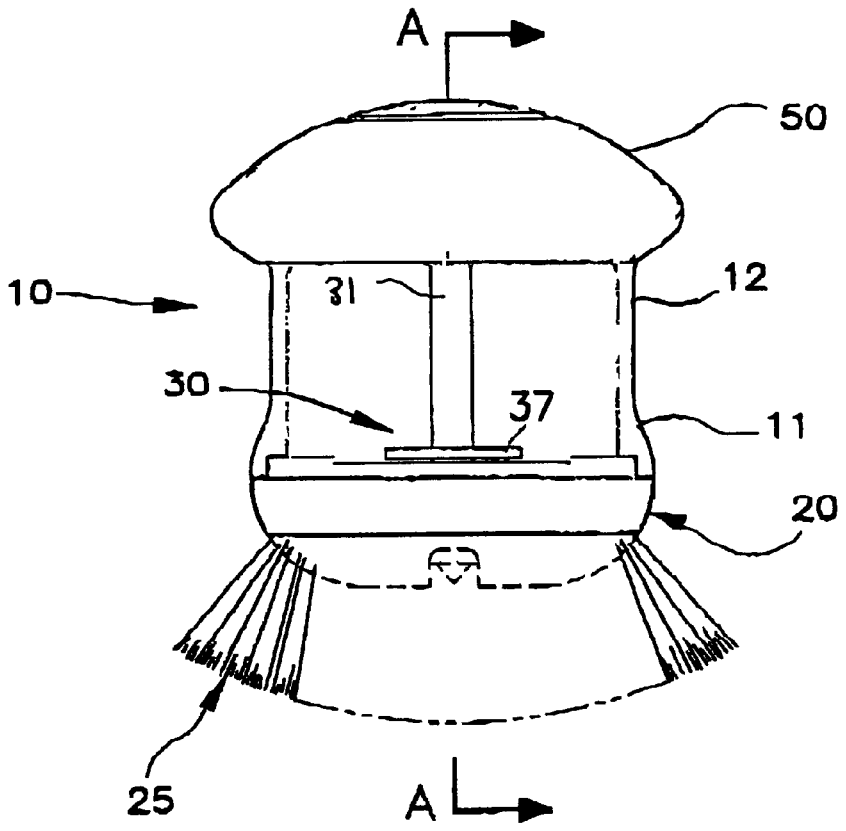
FIG. 1 is a front elevational view of a cleaning device in accordance with an embodiment of the present invention.
Figure 2:
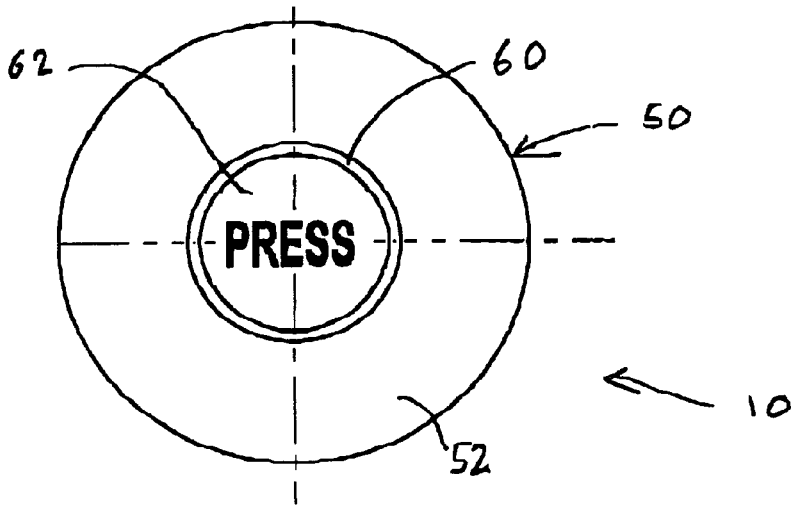
FIG. 2 is a top view of the device of FIG. 1.

Referring to the drawings, there is illustrated a fluid-containing cleaning device generally designated by the numeral 10, constructed in accordance with an embodiment of the present invention. The cleaning device 10 has a housing 11 which includes a generally cylindrical side wall 12, preferably formed of a transparent or translucent material, such as a suitable plastics material. The side wall 12 is joined to a planar shoulder portion 13 which forms a top wall with an outwardly extending lip 14 provided at the junction therebetween. The shoulder portion 13 is joined to an axially extending tubular neck 15 with an outwardly extending bead 16 provided part way up the neck 15, the neck defining an opening through which the device can be filled with a cleaning fluid.

An annular groove 17 is formed in the lower end of the side wall 12 and is adapted to receive therein an annular flange 19 projecting axially from the annular end face 18 of a base wall 20, which may be formed of a suitable plastics material. The base wall 20 is fixedly secured to the side wall 12 for closing the lower end thereof by any suitable means, such as by adhesive or ultrasonic welding.

The base wall 20 has an axial bore 21 formed therethrough (FIGS. 3 and 4) which is provided with an enlarged-diameter counterbore 22 at its inner end and, at its outer end, with a counterbore 23 having a frustoconical inner end wall 24. Fixedly secured to the outer surface of the base wall 20 is a suitable scrubbing medium 25 which, in the illustrated embodiment, comprises a plurality of brush bristles, which may be fixed in sockets 26 in the base wall 20 by any suitable means. Although bristles are illustrated, these could equally be replaced by an abrasive pad, scouring pad, wire wool pad, sponge or other similar cleaning media. It will be appreciated that the axial bore 21 provides communication between the interior of the housing 11 and the cleaning medium 25.

The axial bore 21 is closeable by a valve assembly 30 which includes an elongated valve stem 31 extending axially through the housing 11 and through the axial bore 21, being provided at its distal end with a conical head 32. A valve member in the form of a flexible and resilient O-ring seal 34 is seated in a circumferential groove 33 in the stem 31 immediately above the head 32. The stem 31 preferably has a reduced-diameter neck portion 35 adjacent to the head 32, which is surrounded by a helical compression spring 36, one end of which is seated in the bore 22 and the other end of which is seated against a radially outwardly extending annular flange 37 on the stem 31.The upper end of the stem 31 is formed with an enlarged head 38.

The upper end of the housing 11 is closed by a removable cap 50 which is formed in its entirety of a resilient material such as a rubber, synthetic rubber or elastomer. The cap 50 has a generally dome-shaped upper or outer surface 52, the underside defining a circumferential groove 54 and an adjacent ridge 55 defining a lower opening which when fitted engages beneath the lip 14 with the lip sitting in the groove 54. The cap 50 further includes a downwardly depending tubular skirt 57 which when fitted surrounds the end 38 of the valve stem 31. An inclined surface 58 assists in guiding the end 38 to be correctly seated within the skirt 57. Defined outwardly adjacent the skirt 57 is a further axial recess having an annular surface 59 in which the tubular neck 15 of the housing sits, the bead 16 outwardly engaging the annular surface to assist in providing a fluid-tight engagement of the cap with the housing.

The top of the cap 50 is provided with a circular groove 60 which defines with the groove an actuator button 62. It will be observed that the groove 60 is opposite the recess 59, whereby the cap has at this position a significantly reduced thickness allowing the central portion to be readily inwardly depressed.

The diameter of the cap opening defined by the ridge 55 and groove 54 is slightly smaller than the diameter of the corresponding parts of the end of the housing so that when the cap 50 is fitted thereon at least the periphery thereof is in tension, in particular gripping tightly beneath the lip 14 and on the neck 15, thereby providing a tight and fluid-tight fit. The cap 50 is both fitted and removed by manually stretching it sufficiently to allow the ridge 55 to clear the lip 14.

Figure 5:
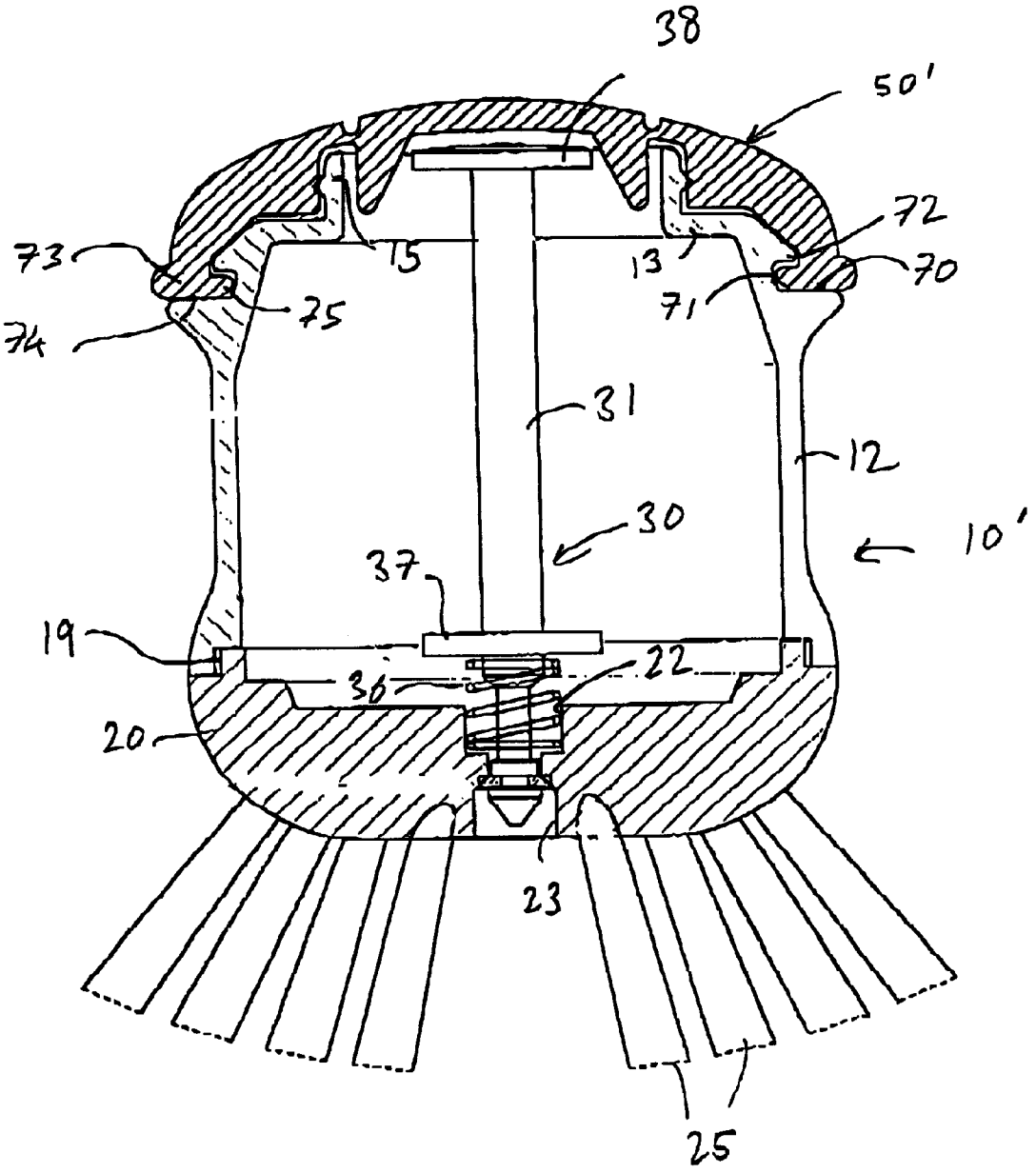
FIG. 5 is a cross-sectional view of a device in accordance with a second embodiment of the invention.

A device 10' in accordance with a second embodiment of the invention is illustrated in FIG. 5. This device 10' is of identical construction to that of the first embodiment with the exception of the shape of the cap and the upper portions of the housing, and like parts are indicated with like reference numerals.

The side wall 12 is formed with a shoulder 13 and neck 15 as described above, but additionally there is a ledge 70 formed at the upper end of the side wall. A groove 71 is defined adjacent the ledge 70 and beneath a lip 72. The cap 50' is formed with an enlarged rim 73 which has a planar lower surface 74 which when fitted sits on the ledge 70, and an inwardly extending flange 75 which extends into the groove 71.

The diameter of the opening defined by the flange 75 is likewise slightly smaller than that of the corresponding end regions of the housing to provide a fluid-tight seal.

Figure 3:
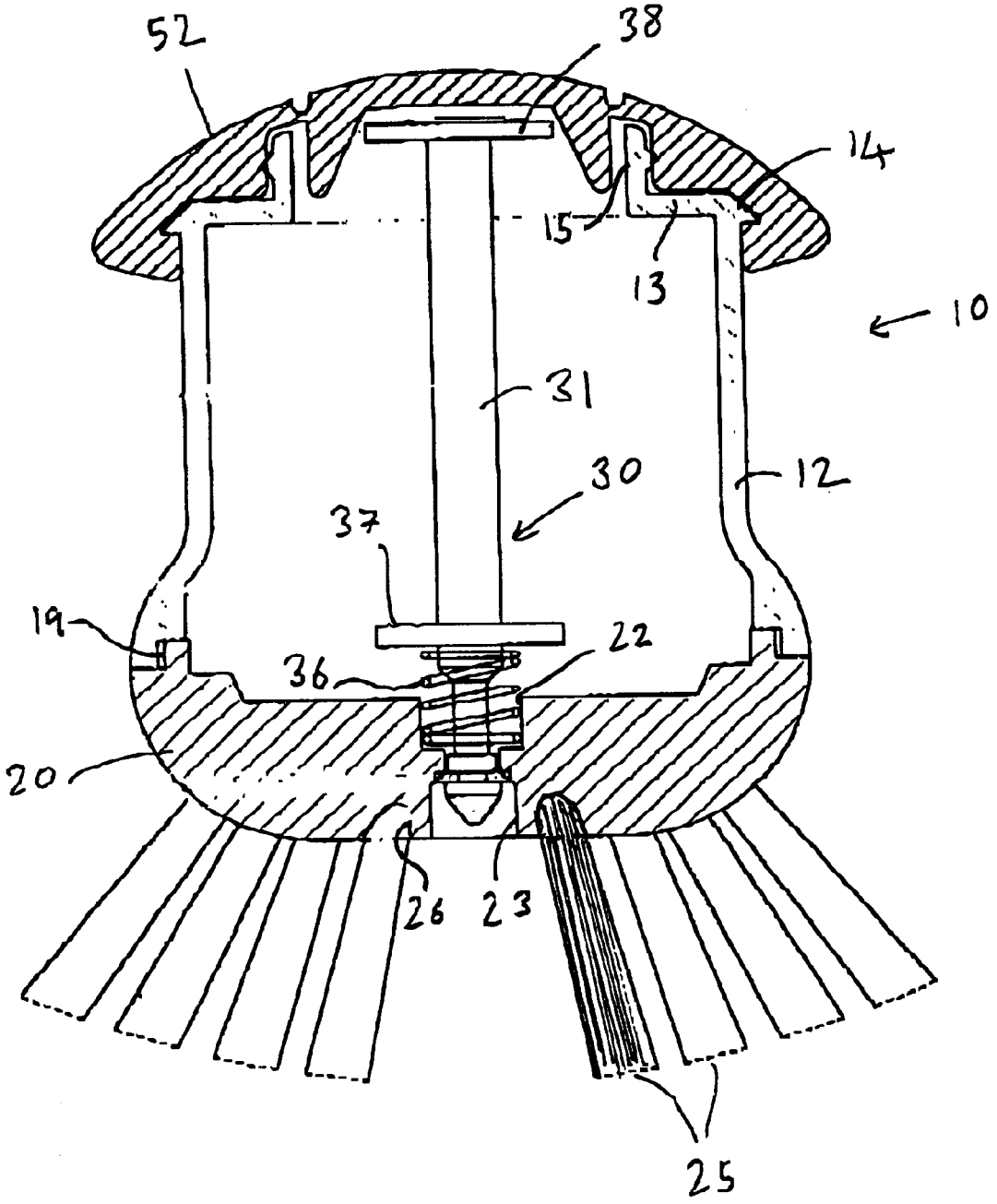
FIG. 3 is a cross-section along the line A—A in FIG. 1.
Figure 4:
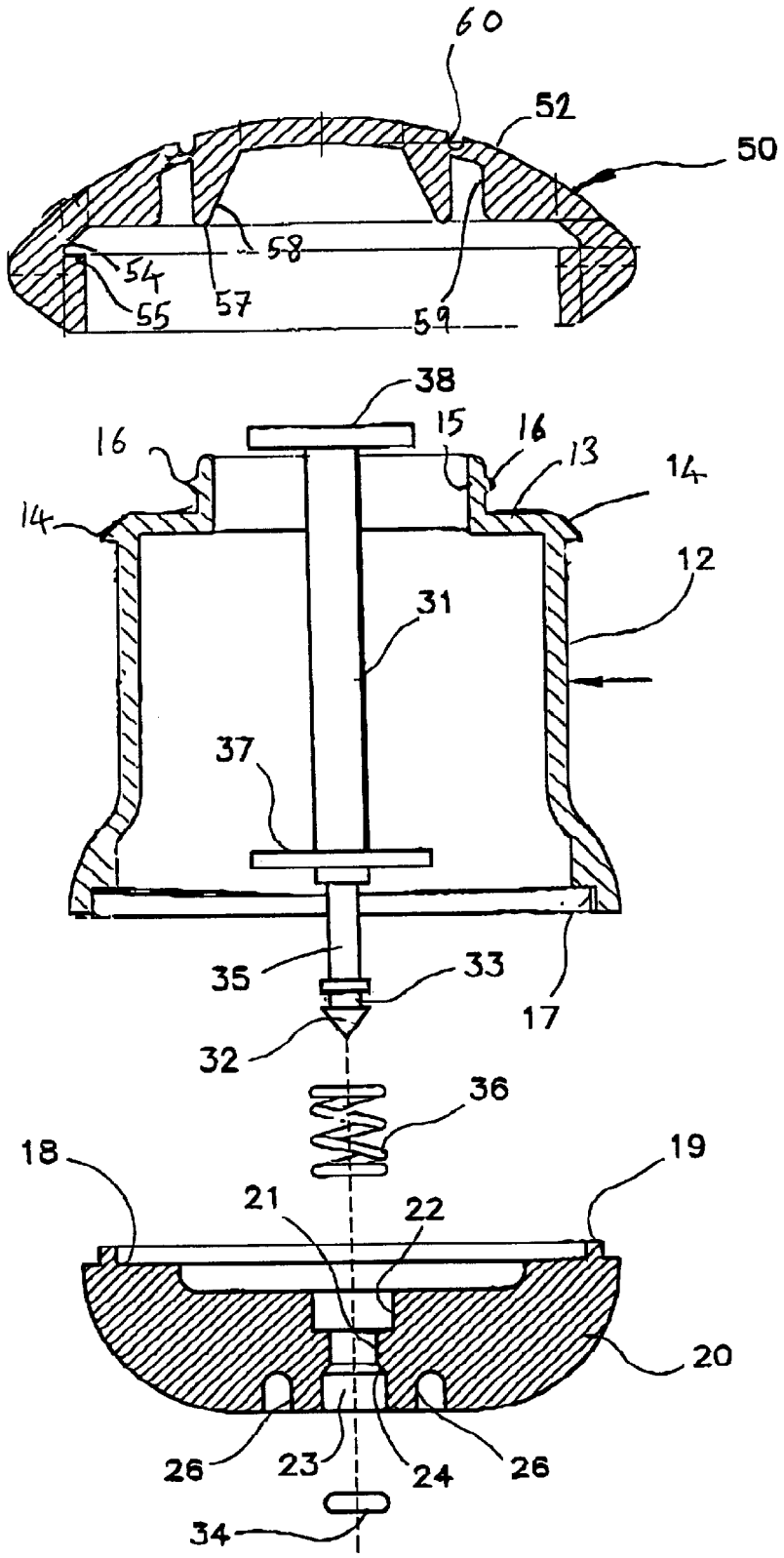
FIG. 4 is an enlarged, exploded, sectional view of the device of FIG. 1.

In use, it will be appreciated that the spring 36 resiliently biases the valve assembly 30 upwardly to a normal closed condition illustrated in FIG. 3, wherein the O-ring seal 34 seats against the wall 24 of the counterbore 23 and cooperates with the stem 31 to seal the opening defined by the axial bore 21. When the actuator button 62 is depressed by the user the inner surface engages the head 38 whereby the stem 31 is also depressed, and the O-ring seal 34 unseats, permitting liquid soap or other fluid to flow through the axial bore 21 to the scrubbing medium 25, the outward movement of the stem 31 being limited by engagement of the flange 37 with the inner surface of the housing base wall 20. When pressure is relaxed from the button 62 the valve stem 31 is upwardly returned to the normal closed condition by the spring 36 with the seal 34 closing the valve seat, and the button 62 returning to its original position by virtue of the resilience of the cap material.

What is claimed is:

1. A hand-held cleaning device comprising a housing constituting a reservoir for cleaning fluid and carrying cleaning means for contacting an object or surface to be cleaned, a lower aperture through which cleaning fluid may pass closed by valve means which is operable by a user, an upper opening through which cleaning fluid may be introduced, wherein the housing has a side wall which is provided in a region of an upper end of the side wall with an outwardly extending circumferential lip, and a removable cap closing the upper opening formed of resilient material and adapted to provide a fluid-tight seal with the housing, the cap having on its underside a circumferential groove into which said circumferential lip fits, and the cap having a portion which is deformable by a user, a part of the valve means extending to said portion whereby a user can operate the valve means on deformation of said portion.

2. A cleaning device according to claim 1 wherein a diameter of the lip is slightly larger than a diameter of the groove whereby, when fitted, the cap is in tension so that a tight seal is formed therebetween.

3. A hand-held cleaning device comprising a housing constituting a reservoir for cleaning fluid and carrying cleaning means for contacting an object or surface to be cleaned, a lower aperture through which cleaning fluid may pass closed by valve means which is operable by a user, an upper opening through which cleaning fluid may be introduced, wherein the housing has a side wall which is provided in a region of an upper end of the side wall with an outwardly extending circumferential lip, and a removable cap closing the upper opening formed of resilient material and adapted to provide a fluid-tight seal with the housing, the cap having a portion which is deformable by a user, a part of the valve means extending to said portion whereby a user can operate the valve means on deformation of said portion, wherein the housing further defines at its uppermost end a neck of reduced diameter defining said upper opening and which is formed with a circumferential bead.

4. A cleaning device according to claim 3 where the cap is supported in its entirety underneath by a portion of the housing, except under that portion which overlies the upper opening.

5. A hand-held cleaning device comprising a housing constituting a reservoir for cleaning fluid and carrying cleaning means for contacting an object or surface to be cleaned, a lower aperture through which cleaning fluid may pass closed by valve means which is operable by a user, an upper opening through which cleaning fluid may be introduced, wherein the housing has a side wall which is provided in a region of an upper end of the side wall with an outwardly extending circumferential lip, and a removable cap closing the upper opening formed of resilient material and adapted to provide a fluid-tight seal with the housing, the cap having a portion which is deformable by a user, a part of the valve means extending to said portion whereby a user can operate the valve means on deformation of said portion, wherein said valve means comprises a valve stem which extends through the housing to the cap and having an end portion which lies adjacent an inner surface of the deformable portion of the cap, and said valve means includes a valve member arranged on an end of the valve stem which sits in a valve seat, the valve stem being biased by resilient means towards the cap so that the valve member engages in the valve seat.

6. A hand-held cleaning device comprising a housing constituting a reservoir for cleaning fluid and carrying cleaning means for contacting an object or surface to be cleaned, a lower aperture through which cleaning fluid may pass closed by valve means which are operable by a user, an upper opening through which cleaning fluid may be introduced, wherein the housing has a side wall which is provided in a region of an upper end of the side wall with an outwardly extending circumferential lip, and a removable cap closing the upper opening formed of resilient material and adapted to provide a fluid-tight seal with the housing, the cap having a portion which is deformable by a user, a part of the valve means extending to said portion whereby a user can operate the valve means on deformation of the said portion, wherein the cap is provided with a cylindrical skirt portion depending from the inner surface thereof in which an end portion of the valve stem is received.

7. A cleaning device according to claim 2 wherein there is formed a circular groove in an outer surface of the cap defining a deformable button portion.

8. A cleaning device according to claim 1 wherein the cap is formed of a synthetic rubber.

9. A cleaning device according to claim 1 wherein the cap is formed of an elastomer.

10. A hand-held cleaning device comprising a housing constituting a reservoir for cleaning fluid and carrying cleaning means for contacting an object or surface to be cleaned, a lower aperture through which cleaning fluid may pass closed by valve means which are operable by a user, an upper opening through which cleaning fluid may be introduced, and a removable cap closing the upper opening formed of resilient material and adapted to provide a fluid-tight seal with the housing, the cap having a portion which is deformable by a user, a part of the valve means extending to said portion, wherein the cap is provided with a cylindrical skirt portion depending from an inner surface thereof in which an end portion of the valve means is received, the skirt having an inclined interior surface portion whereby a user can operate the valve means on deformation of the said portion and the inclined interior surface of the skirt guides the portion of the valve means upon release of the portion of the cap.

11. A hand-held cleaning device comprising a housing constituting a reservoir for cleaning fluid and carrying cleaning means for contacting an object or surface to be cleaned, a lower aperture through which cleaning fluid may pass closed by valve means which is operable by a user, an upper opening through which cleaning fluid may be introduced, and a removable cap closing the upper opening formed of resilient material and adapted to provide a fluid-tight seal with the housing, the cap having a portion which is deformable by a user, a part of the valve means extending to said portion whereby a user can operate the valve means on deformation of said portion, wherein the housing further defines at its uppermost end a neck of reduced diameter defining said upper opening and which is formed with a circumferential bead, said cap defining an annular surface that engages said neck with said circumferential bead thereof tightly fitting against said annular surface.

* * * * *